US006739689B2

(12) United States Patent
Choi

(10) Patent No.: US 6,739,689 B2
(45) Date of Patent: May 25, 2004

(54) INK CARTRIDGE IDENTIFYING APPARATUS

(75) Inventor: Kyung-chool Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 38 days.

(21) Appl. No.: 10/313,004

(22) Filed: Dec. 6, 2002

(65) Prior Publication Data

US 2003/0218649 A1 Nov. 27, 2003

(30) Foreign Application Priority Data

May 27, 2002 (KR) ..... 2002-29308

(51) Int. Cl.[7] ..... B41J 29/393; B41J 29/38

(52) U.S. Cl. ..... 347/19; 347/14

(58) Field of Search ..... 347/19, 14, 23, 347/86, 85, 12, 10, 11, 84, 71, 5, 51, 8, 9, 17, 7, 30, 33, 88; 400/124.04

(56) References Cited

U.S. PATENT DOCUMENTS 5,506,611 A * 4/1996 Ujita et al. ..... 347/86

* cited by examiner

*Primary Examiner*—Stephen D. Meier
*Assistant Examiner*—Charles Stewart, Jr.
(74) *Attorney, Agent, or Firm*—Staas & Halsey LLP

(57) ABSTRACT

An ink cartridge identifying apparatus of a printer which is capable of selectively mounting two or more kinds of ink cartridges therein for printing includes an identifying unit, a sensing unit, and a micro processing unit. The identifying unit is prepared on a body of the ink cartridge. The sensing unit is prepared in a carriage mounted with the ink cartridge therein so as to sense the identifying unit. The micro processing unit identifies what kind of cartridge the ink cartridge is, by using signals detected from the sensing unit. In this structure, it is possible to identify the kind of the ink cartridge without adding electrical contact nodes to a flexible printed circuit of the ink cartridge.

10 Claims, 6 Drawing Sheets

INK CARTRIDGE IDENTIFYING APPARATUS

CROSS-REFERENCE TO RELATED APPLICATIONS

This application claims the benefit of Korean Patent Application No. 2002-29308, filed May 27, 2002, in the Korean Intellectual Property Office, the disclosure of which is incorporated herein by reference.

BACKGROUND OF THE INVENTION

1. Field of the Invention

The present invention relates to an ink cartridge identifying apparatus of an inkjet printer which selectively mounts one of several kinds of ink cartridges therein to print an image, and particularly, to an ink cartridge identifying apparatus identifying a kind of an ink cartridge mounted in a carrier of an inkjet printer.

2. Description of the Related Art

In general, when transferring a printing paper, an inkjet printer discharges an ink droplet to the printing paper through an ink cartridge which is mounted in a carriage that is spaced apart from an upper surface of the printing paper to slide over the printing paper in order to form an image on the printing paper. Currently, different kinds of ink cartridges, such as a mono cartridge containing ink in a single color, a color cartridge containing ink in at least two colors, a photo cartridge containing photo ink, or the like, can be selectively mounted in the carriage to print a color image as well as black and white images. Further, the inkjet printer, which is capable of printing photo-like high quality images, is generalized.

In order to obtain high quality images from such an inkjet printer, appropriate control operations have to be carried out depending on what kind of ink cartridge the ink cartridge is. Thus, it is necessary to determine the kind of ink cartridge mounted in the carriage.

Referring to FIGS. 1 and 2, a conventional ink cartridge identifying apparatus includes a first contact node part 120 which is prepared in a flexible printed circuit (FPC) 110 that is attached to a body of an ink cartridge 100, a second contact node part 150 which is prepared in a contact part 140 that is prepared in a carriage 130 mounted with the ink cartridge 100 therein and contacts the FPC 110, and which is connected to the first contact node part 120, and a micro processing unit (MPU) 160 which is connected to the second contact node part 150.

The ink cartridge 100 includes a plurality of discharging units (not shown) which discharge ink. The MPU 160 controls timing for discharging the ink, an amount of the discharged ink, and the like. Thus, the ink cartridge 100 includes the FPC 110 which has a plurality of electrical contact nodes connecting the discharging units to the MPU 160.

When the ink cartridge 100 is mounted in the carriage 130, the first contact node part 120 is connected to the second contact node part 150. Thus, as shown in FIG. 2, contact nodes a, b, and c are connected to contact nodes d, e, and f, respectively. Here, since the contact node f is ground, the contact node c connected thereto is also ground. The contact nodes d and e are supplied with powers Vc of 5V through resistances R and connected to input nodes g and h of the MPU 160, respectively.

The contact nodes a and b of the first contact node part 120 are selectively connected to the contact node c inside the FPC 110 depending on a kind of the ink cartridge 100. Thus, depending on whether the contact nodes a and b are ground, i.e., whether the contact nodes a and b are connected to the contact node c, voltages of 5V or 0V are applied to the input nodes g and h of the MPU 160.

If only the contact node a is connected to the contact node c, a voltage of 0V is applied to the input node g and thus a low signal L is input to the input node g, and a voltage of 5V is applied to the input node h and thus a high signal H is input to the input node h. If only the contact node b is connected to the contact node c, the high signal H is input to the input node g and the low signal L is input to the input node h. If both of the contact nodes a and b are connected to the contact node c, the low signal L is input to both of the input nodes g and h.

Using this relationship, in a mono cartridge containing ink in a single color, only the contact node a is connected to the contact node c, in a color cartridge containing ink in at least two colors, only the contact node b is connected to the contact node c, and in a photo cartridge, both of the contact nodes a and b are connected to the contact node c. Then, high signals H or low signals L are input to the input nodes g and h depending on whether the contact nodes a and b are connected to the contact node c, and the MPU 160 determines the kind of the ink cartridge 110 mounted in the carriage 130 by using the high signals H or the low signals L.

However, in the above-described ink cartridge identifying apparatus, the first contact node part 120, in which a connection between the contact nodes a and b and the contact node c varies depending on the kind of the ink cartridge 100, is formed in the FPC 110. Thus, the electrical contact node structure of the FPC 110 of the ink cartridge 100 becomes complicated.

SUMMARY OF THE INVENTION

To solve the above and the other problems, it is an aspect of the present invention to provide an ink cartridge identifying apparatus which can identify what kind of cartridge an ink cartridge is mounted in a carriage, by identifying an identifying unit formed on a body of the ink cartridge without installing an electrical contact node structure in a flexible printed circuit (FPC) of the ink cartridge.

Additional aspects and advantages of the invention will be set forth in part in the description which follows and, in part, will be obvious from the description, or may be learned by practice of the invention.

Accordingly, to achieve the above and/or the other aspects, there is provided an ink cartridge identifying apparatus of a printer which is capable of selectively mounting two or more kinds of ink cartridges therein for printing. The ink cartridge identifying apparatus includes an identifying unit, a sensing unit, and a micro processing unit. The identifying unit is prepared on a body of the ink cartridge. The sensing unit is prepared in a carriage mounted with the ink cartridge therein so as to sense the identifying unit. The micro processing unit identifies what kind of cartridge the ink cartridge is, by using signals detected from the sensing unit.

The identifying unit includes at least one protrusion piece which selectively protrudes from the body of the ink cartridge depending on the kind of the ink cartridge.

The identifying unit includes at least one reflective surface which is selectively prepared on the body of the ink cartridge depending on the kind of the ink cartridge.

BRIEF DESCRIPTION OF THE DRAWINGS

These and other aspects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
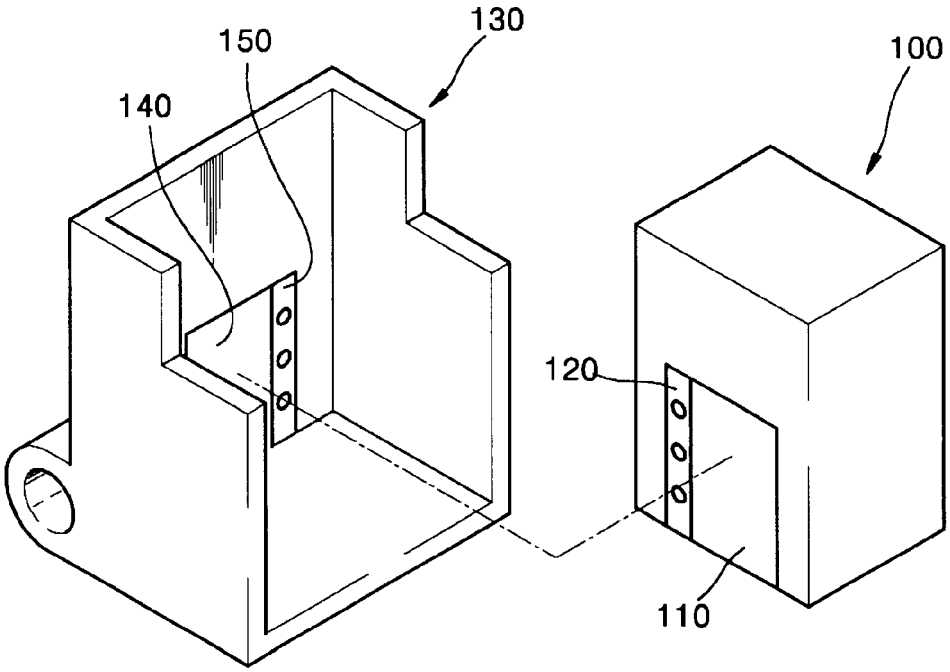
FIG. 1 (PRIOR ART)
FIG. 1 is an exploded perspective view of a conventional ink cartridge identifying apparatus.
Figure 2:
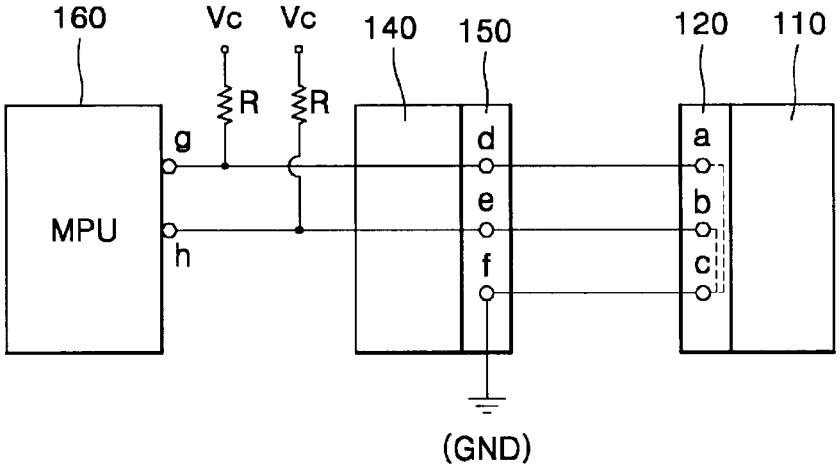
FIG. 2 (PRIOR ART)
FIG. 2 is a circuit diagram of the conventional ink cartridge identifying unit shown in FIG. 1.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 3:
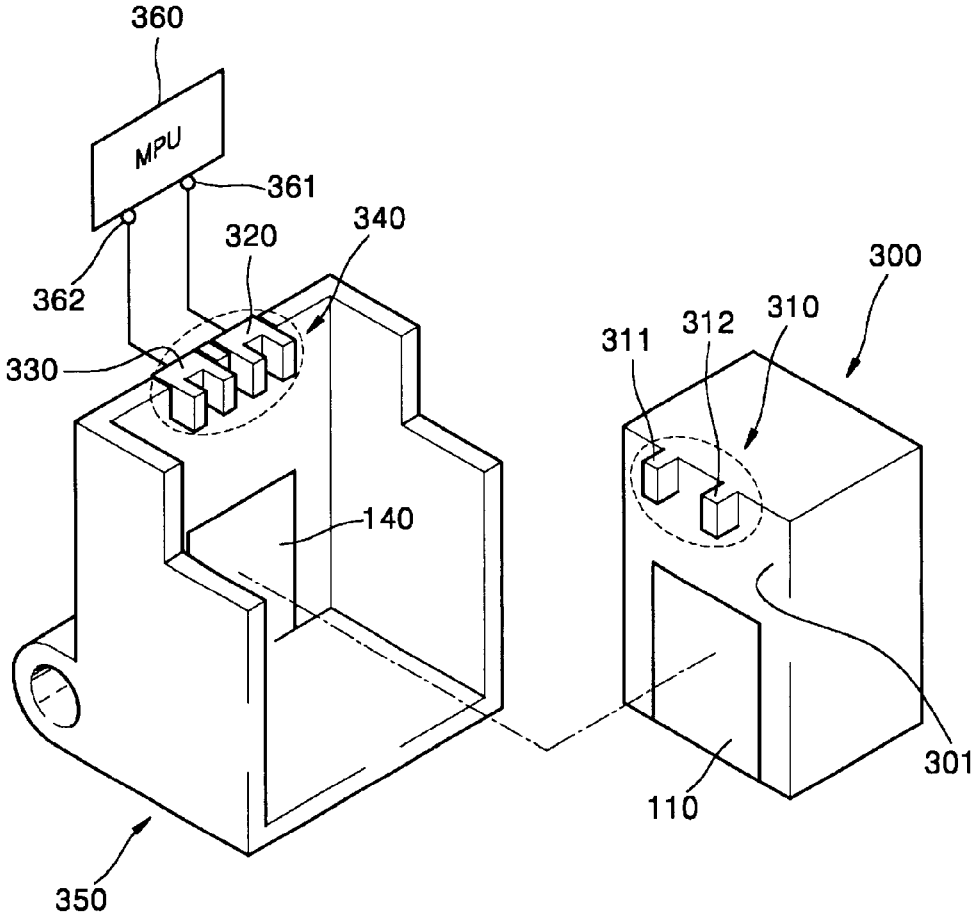
FIG. 3 is an exploded perspective view of an ink cartridge identifying apparatus according to an embodiment of the present invention.

FIG. 3 is an exploded perspective view of an ink cartridge identifying apparatus according to an embodiment of the present invention. In this embodiment, the ink cartridge identifying apparatus of an inkjet printer in which a monocartridge containing ink in a single color, a color cartridge containing ink of at least two colors, or a photocartridge containing photo ink which can be selectively mounted will be described.

As shown in FIG. 3, the ink cartridge identifying apparatus includes an identifying unit 310 which is prepared on a rear surface 301 of a body of an ink cartridge 300 having a flexible printed circuit (FPC) 110, an sensing unit 340 which is prepared in a carriage 350 mounted with the ink cartridge 300 therein and senses the identifying unit 310, and a micro processing unit (MPU) 360. The carriage 350 includes a contact part 140 contacting the FPC 110 of the ink cartridge 300 to transmit printing information.

Figure 4A:
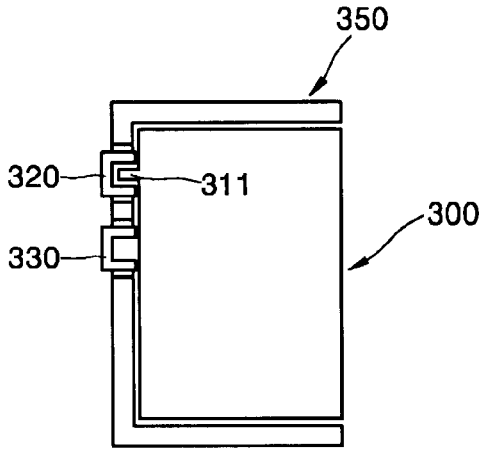
FIGS. 4A through 4C are views showing shapes of an identifying unit of the ink cartridge identifying apparatus shown in FIG. 3.
Figure 4B:
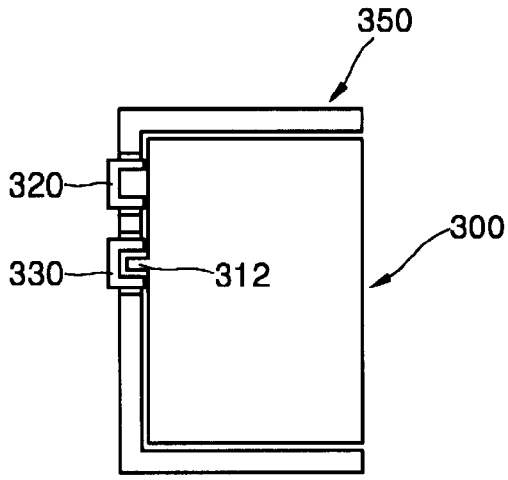
Figure 4C:
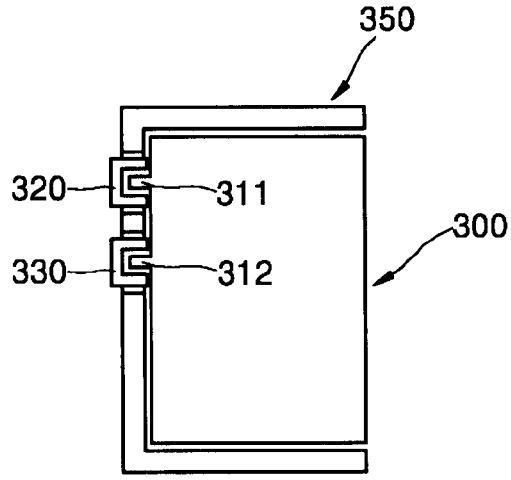

The identifying unit 310 includes first and second protrusion pieces 311 and 312 which selectively protrude from the back surface 301 of the body of the ink cartridge 300 toward the carriage 350 depending on what kind of cartridge the ink cartridge 300 is. As shown in FIGS. 4A through 4C, the identifying unit 310 may have only the first protrusion piece 311, only the second protrusion piece 312, or both of the first and second protrusion pieces 311 and 312. Thus, the identifying units shown in FIGS. 4A through 4 C may be formed in a monocartridge, a color cartridge, or a photocartridge.

The identifying unit 310 may protrude as described above or may be indented inward the ink cartridge 300. Also, the identifying unit 310 may be formed on a right surface, a left surface, or a lower surface as well as the rear surface 301 of the body of the ink cartridge 300.

The sensing unit 340 includes first and second light sensors 320 and 330 that are prepared in the carriage 350 so as to detect the first and second protrusion pieces 311 and 312, respectively.

Figure 5:
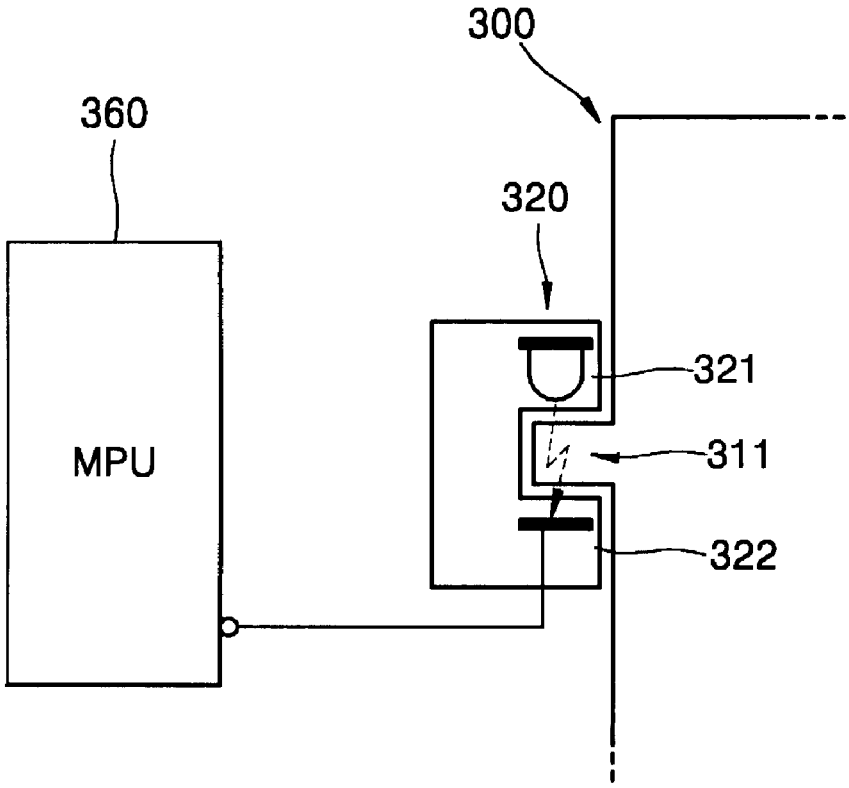
FIG. 5 is a detailed view of a sensing unit shown in FIG. 3.

As shown in FIG. 5, the first and second light sensors 320 and 330 respectively include a light emitter 321 and a light receiver 322. When the ink cartridge 300 is mounted in the carriage 350, the first and second protrusion pieces 311 and 312 are respectively positioned between the light emitter 321 and the light receiver 322. Thus, it is detected whether light emitted from the light emitter 321 is incident on the light receiver 322 to detect whether the first and second protrusion pieces 311 and 312 exist. In this embodiment, the first and second light sensors 320 and 330 are used as the sensing unit 340. However, micro-switches (not shown), which are operated by the first and second protrusion pieces 311 and 312, may be used as the sensing unit 340.

Signals detected from the light receivers 322 of the first and second light sensors 320 and 330 are input to first and second input nodes 361 and 362 of the MPU 360, respectively. Then, the MPU 360 recognizes the input signals as logic high values H if the first and second protrusion pieces 311 and 312 exist, or logic low values L if the first and second protrusion pieces 311 and 312 do not exist. The opposite case is possible.

The logic values of the first and second input nodes 361 and 362 that are recognized in the MPU 360 depending on whether the first and second protrusion pieces 311 and 312 exist, are described in Table 1. Using theses logic values, it is possible to identify what kind of cartridge the ink cartridge 300 is, and whether the ink cartridge 300 is mounted in the carriage 350.

TABLE 1

| | Identifying Unit | First Input Node | Second Input Node |
|---|---|---|---|
| Monocartridge | First Protrusion Piece | H | L |
| Color cartridge | Second Protrusion Piece | L | H |
| Photocartridge | First & Second Protrusion Piece | H | H |
| No Cartridge | — | L | L |

Figure 6:
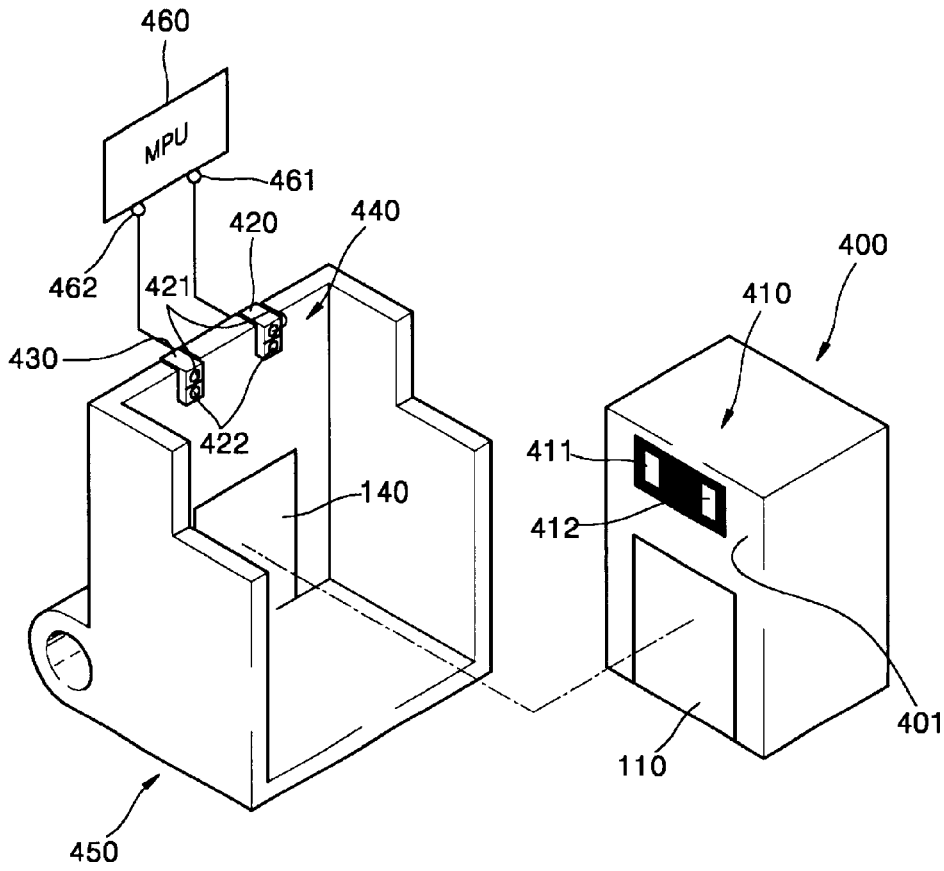
FIG. 6 is an exploded perspective view of an ink cartridge identifying apparatus according to another embodiment of the present invention.

FIG. 6 is an exploded perspective view of an ink cartridge identifying apparatus according to another embodiment of the present invention. As shown in FIG. 6, the identifying apparatus includes an identifying unit 410 which has first and second reflective surfaces 411 and 412 that are selectively positioned on a rear surface 401 of an ink cartridge 400 depending on what kind of cartridge the ink cartridge 400 is, a sensing unit 440 which is positioned in a carriage 450 mounted with the ink cartridge 400 therein, and which has first and second light sensors 420 and 430 that detect the first and second reflective surfaces 411 and 412, respectively, and a MPU 460.

Figure 7A:
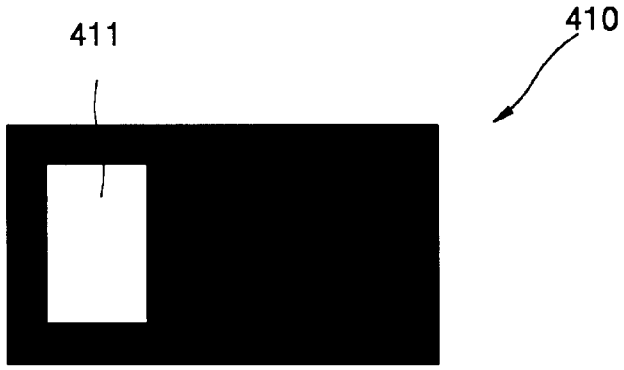
FIGS. 7A through 7C are views showing arrangements of an identifying unit the ink cartridge identifying apparatus shown in FIG. 6.
Figure 7B:
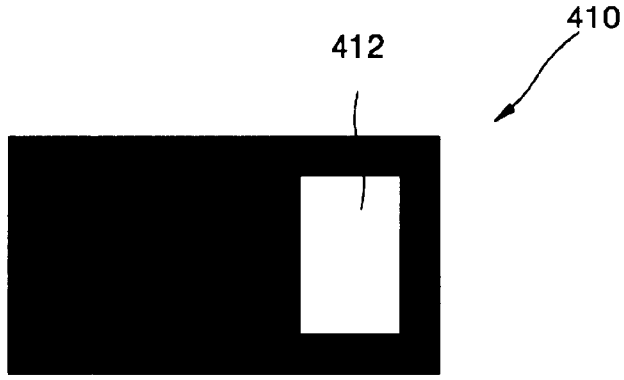
Figure 7C:
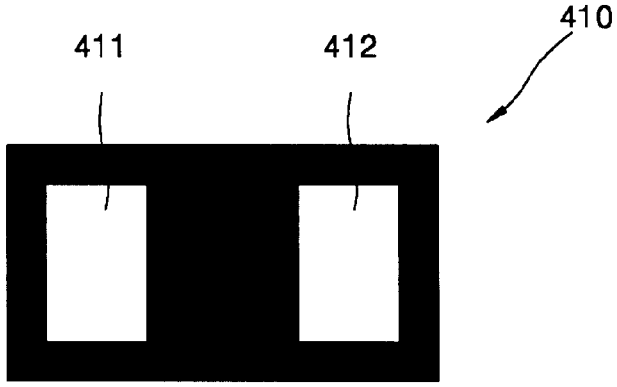

FIGS. 7A through 7C show arrangements of the first and second reflective surfaces 411 and 412 depending on a kind of the ink cartridge 400. As shown in FIGS. 7A through 7 C, only the first reflective surface 411, only the second reflective surface 412, or both of the first and second reflective surfaces 411 and 412 may be formed. Thus, identifying units shown in FIGS. 7A through 7C may be positioned in a monocartridge, a color cartridge, or a photocartridge.

As shown in FIGS. 7A through 7C, the identifying unit 410 is formed by coating the rear surface 401 of the ink cartridge 400 with a light reflecting material or a light-absorbing material or by attaching a light reflecting sheet or a light-absorbing sheet onto the rear surface 401 of the ink cartridge 400. Also, the identifying unit 410 may be formed on a right surface, a left surface, or a lower surface of a body of the ink cartridge 400.

The first and second light sensors 420 and 430 respectively have a light emitter 421 and a light receiver 422 that are formed toward the first and second reflective surfaces 411 and 412. When the ink cartridge 400 is mounted in the carriage 450, it is detected whether light emitted from the light emitter 421 is incident on the light receiver 422.

Signals detected from the light receivers 422 of the first and second light sensors 420 and 430 are input to first and second input nodes 461 and 462 of the MPU 460, respectively. Then, the MPU 460 recognizes the input signals as logic high values H if the first and second reflective surfaces 411 and 412 exist, or logic low values L if the first and second reflective surfaces 411 and 412 do not exist. The opposite case is possible.

The logic values of the first and second input nodes 461 and 462 that are recognized in the MPU 460 depending on whether the first and second reflective surfaces 411 and 412 exist are described in Table 2.

TABLE 2

| | Identifying Unit | First Input Node | Second Input Node |
|---|---|---|---|
| Mono cartridge | First Reflective Surface | L | H |
| Color cartridge | Second Reflective Surface | H | L |
| Photo cartridge | First & Second Reflective Surface | L | L |
| No Cartridge | — | H | H |

As shown in Tables 1 and 2, the MPU 460 can detect four different logic states. In this embodiment, three kinds of the mounted ink cartridge 400 are described. Thus, when in Table 1, both the logic values of the first and second input nodes 361, 362 are low signals L, and in Table 2, both the logic values of the first and second input nodes 461, 462 are high signals H, it can be determined that the ink cartridge 300, 400 is not mounted in the carriage 350, 450.

In these embodiments, three kinds of the ink cartridges are identified. However, four kinds of the ink cartridges may be identified by properly adjusting the number of identifying units, sensing units, and input nodes of the MPU.

It is possible to identify a kind of an ink cartridge by using protrusion structures or reflective structures, which are prepared on the ink cartridge, as an identifying unit capable of identifying the kind of the ink cartridge without changing an electrical contact structure of a FPC of the ink cartridge.

As described above, according to an ink cartridge identifying apparatus of the present invention, an identifying unit that is prepared on a body of an ink cartridge, can be sensed to identify what kind of cartridge the ink cartridge is. Thus, an electrical contact structure of a FPC of the ink cartridge can be prevented from being complicated and it can be detected whether the ink cartridge is mounted.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. An ink cartridge identifying apparatus of a printer having a carriage mounted with one of two or more kinds of ink cartridges therein for printing, the ink cartridge having a first surface having a flexible printed circuit (FPC), and the carriage having a second surface containing a contact part contacting the FPC to transmit printing information for the printing, the ink cartridge identifying apparatus comprising:

an identifying unit formed on the ink cartridge and spaced-apart from the FPC;

a sensing unit formed in the carriage mounted with the ink cartridge to detect the identifying unit and generate a signal; and a micro processing unit identifying what kind of cartridge the ink cartridge is, in response to the signal of the sensing unit.

2. The ink cartridge identifying apparatus of claim 1, wherein the sensing unit is spaced-apart from the contact part.

3. The ink cartridge identifying apparatus of claim 1, wherein the identifying unit is formed on the first surface of the ink cartridge.

4. The ink cartridge identifying apparatus of claim 1, wherein the ink cartridge comprises a third surface which is not disposed on a plane of the first surface, and the identifying unit is formed on the third surface of the ink cartridge.

5. The ink cartridge identifying apparatus of claim 1, wherein the sensing unit is formed on the second surface.

6. The ink cartridge identifying apparatus of claim 1, wherein the carriage comprises a third surface which in not disposed on a plane of the second surface, and the sensing unit is formed on the third surface.

7. The ink cartridge identifying apparatus of claim 1, wherein the sensing unit does not contact the identifying unit while the contact part contacts the FPC when the ink cartridge is mounted on the carriage.

8. The ink cartridge identifying apparatus of claim 1, wherein the FPC comprises first nodes, the contact part comprises second nodes electrically contacted to corresponding ones of the first nodes of the FPC, and the sensing unit is not electrically connected to the identifying unit.

9. The ink cartridge identifying apparatus of claim 8, wherein the sensing unit comprises:

an optical sensor detecting the identifying unit using light.

10. The ink cartridge identifying apparatus of claim 1, wherein the sensing unit comprises:

a micro-switch detecting the identifying unit and generating the signal.

* * * * *